US010517395B2

(12) United States Patent
Wasserman

(10) Patent No.: US 10,517,395 B2
(45) Date of Patent: Dec. 31, 2019

(54) MODULAR MULTI-USE SURFACE SET

(71) Applicant: KPI ENTERTAINMENT, INC., Oak Park, CA (US)

(72) Inventor: Adam Wasserman, Oak Park, CA (US)

(73) Assignee: KPI ENTERTAINMENT, INC., Oak Park, CA (US)

( * ) Notice: Subject to any disclaimer, the term of this patent is extended or adjusted under 35 U.S.C. 154(b) by 25 days.

(21) Appl. No.: 15/681,384

(22) Filed: Aug. 19, 2017

(65) Prior Publication Data

US 2018/0049547 A1 Feb. 22, 2018

Related U.S. Application Data

(60) Provisional application No. 62/377,521, filed on Aug. 19, 2016.

(51) Int. Cl.

| | |
|---|---|
| ***A47B 57/00*** | (2006.01) |
| ***A47B 87/00*** | (2006.01) |
| ***A63B 67/00*** | (2006.01) |
| ***A47B 3/091*** | (2006.01) |
| ***A47B 3/087*** | (2006.01) |
| ***A47B 25/00*** | (2006.01) |
| *A63B 67/06* | (2006.01) |
| *A63B 71/00* | (2006.01) |
| *A63F 7/00* | (2006.01) |
| *A63F 7/36* | (2006.01) |

(52) U.S. Cl.

CPC ..... *A47B 87/002* (2013.01); *A47B 3/087* (2013.01); *A47B 3/0912* (2013.01); *A47B 25/00* (2013.01); *A63B 67/002* (2013.01); *A47B 2200/0039* (2013.01); *A63B 67/066* (2013.01); *A63B 71/0036* (2013.01); *A63B 2209/10* (2013.01); *A63B 2210/50* (2013.01); *A63B 2225/093* (2013.01); *A63F 7/0017* (2013.01); *A63F 2007/3692* (2013.01); *A63F 2250/024* (2013.01)

(58) Field of Classification Search

CPC ..... A47B 87/002; A47B 3/00; A47B 3/08; A47B 3/0818; A47B 3/091; A47B 3/0918; A47B 3/12; A47B 2003/0821; A47B 2003/0824; A47B 2003/0827; A47B 2087/004

USPC ..... 108/166, 167, 168

See application file for complete search history.

(56) References Cited

U.S. PATENT DOCUMENTS

| | | | | | |
|---|---|---|---|---|---|
| 2,643,926 | A * | 6/1953 | Pucci | A47B 3/083 | 108/131 |
| 2,903,313 | A * | 9/1959 | Block | A47B 3/083 | 108/35 |
| 5,357,872 | A * | 10/1994 | Wilmore | A47B 3/087 | 108/132 |
| 9,462,880 | B1 * | 10/2016 | Lin | A47B 3/087 | |
| 2007/0215011 | A1 * | 9/2007 | Khan | A45C 9/00 | 108/11 |
| 2010/0058958 | A1 * | 3/2010 | Christian | A47B 3/0912 | 108/19 |

(Continued)

*Primary Examiner* — Matthew W Ing

(74) *Attorney, Agent, or Firm* — Ferguson Case Orr Paterson

(57) ABSTRACT

A modular multi-use surface set that may be configured for use in several modes including a table mode, a platform mode, and a carry mode. The convertible set is particularly well-suited for use as both a Beer Pong table and a pair of Cornhole platforms.

19 Claims, 12 Drawing Sheets

(56) References Cited

U.S. PATENT DOCUMENTS

| | | | | |
|---|---|---|---|---|
| 2011/0094030 | A1* | 4/2011 | Harrington | A47B 81/005 5/503.1 |
| 2017/0082342 | A1* | 3/2017 | Weinberg | F25D 3/08 |

* cited by examiner

FIG. 2
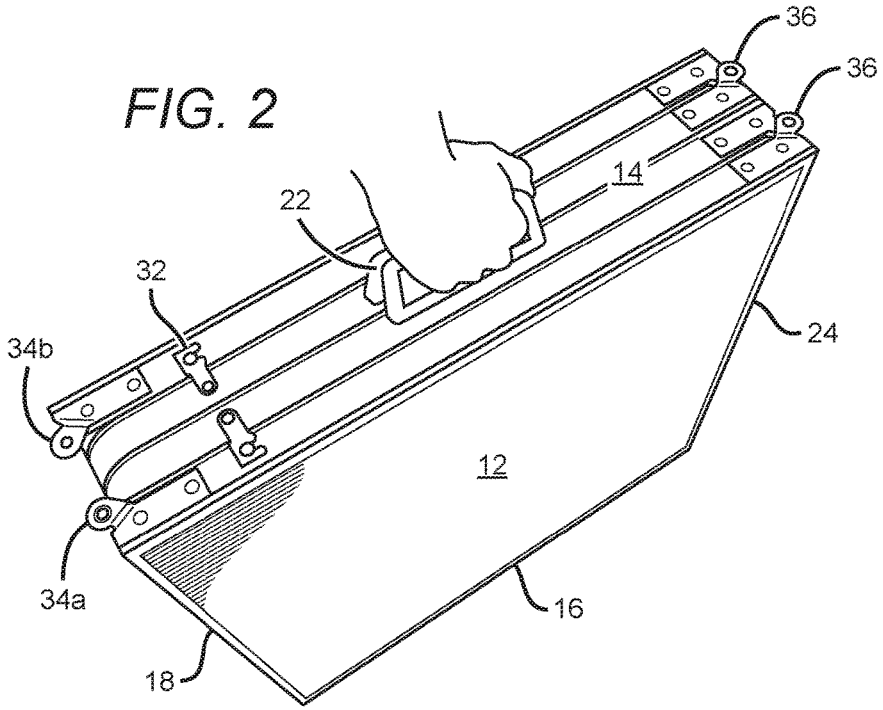
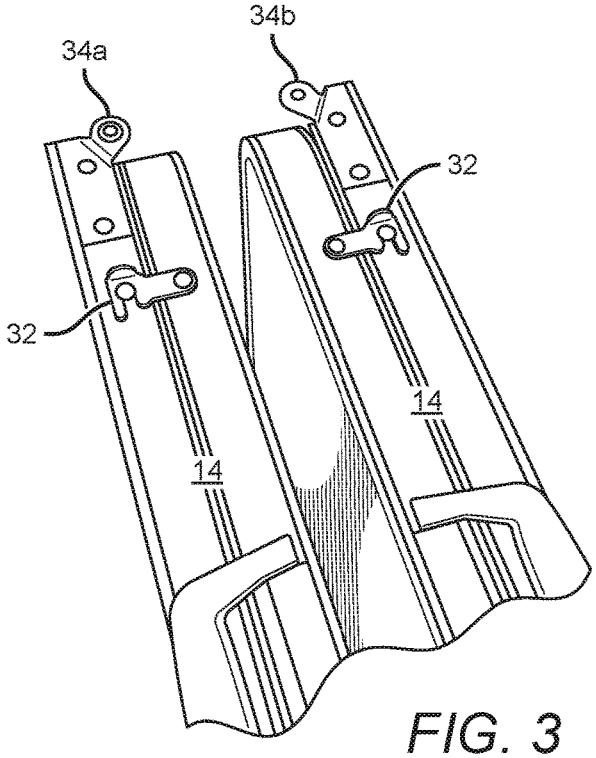
FIG. 3

FIG. 4
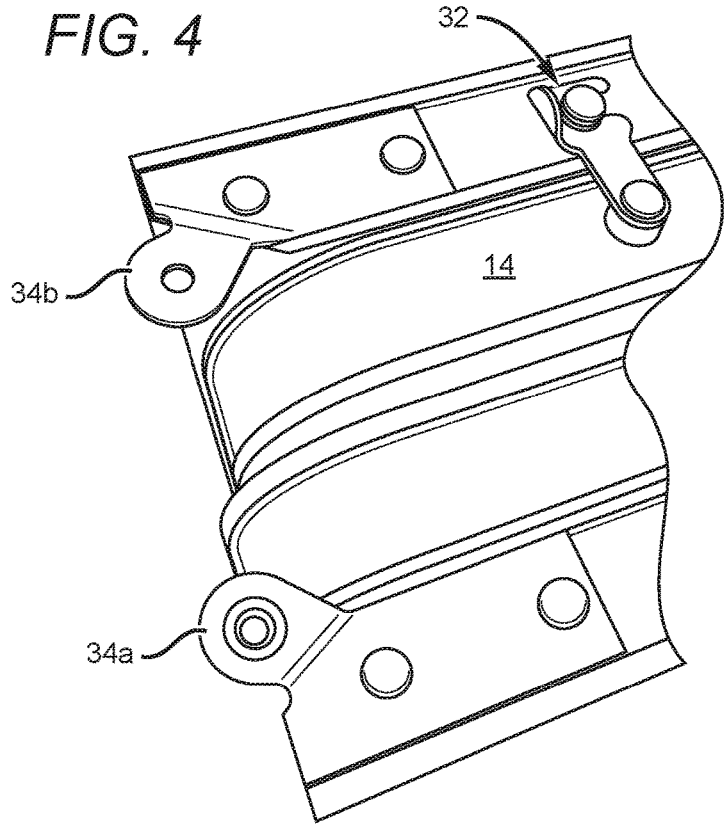
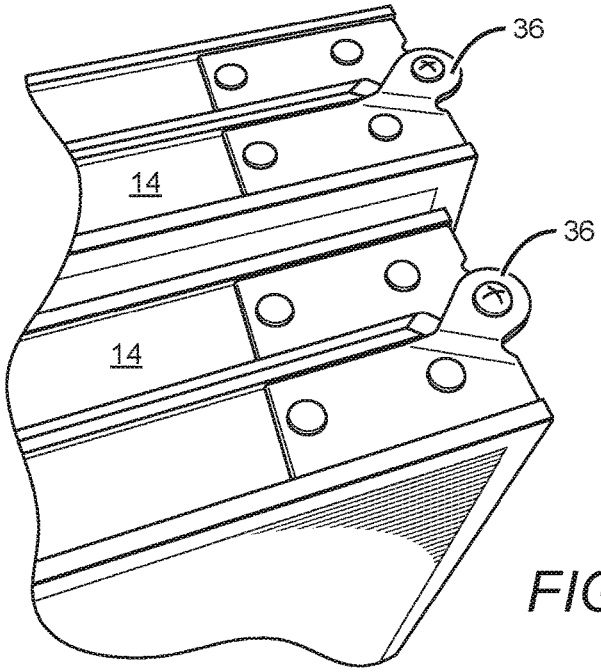
FIG. 5

FIG. 8A
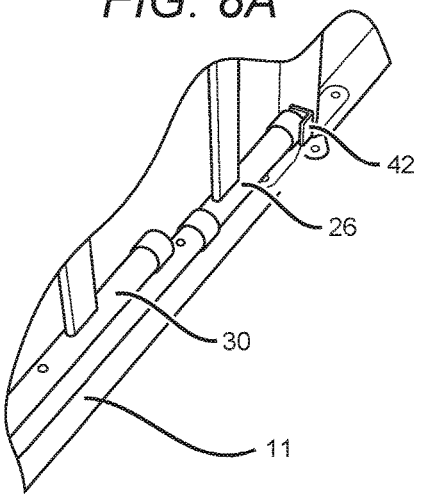
FIG. 8B
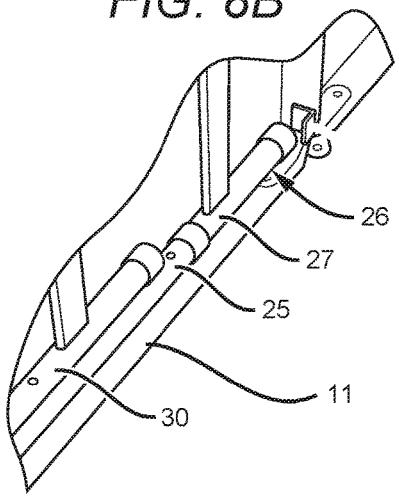
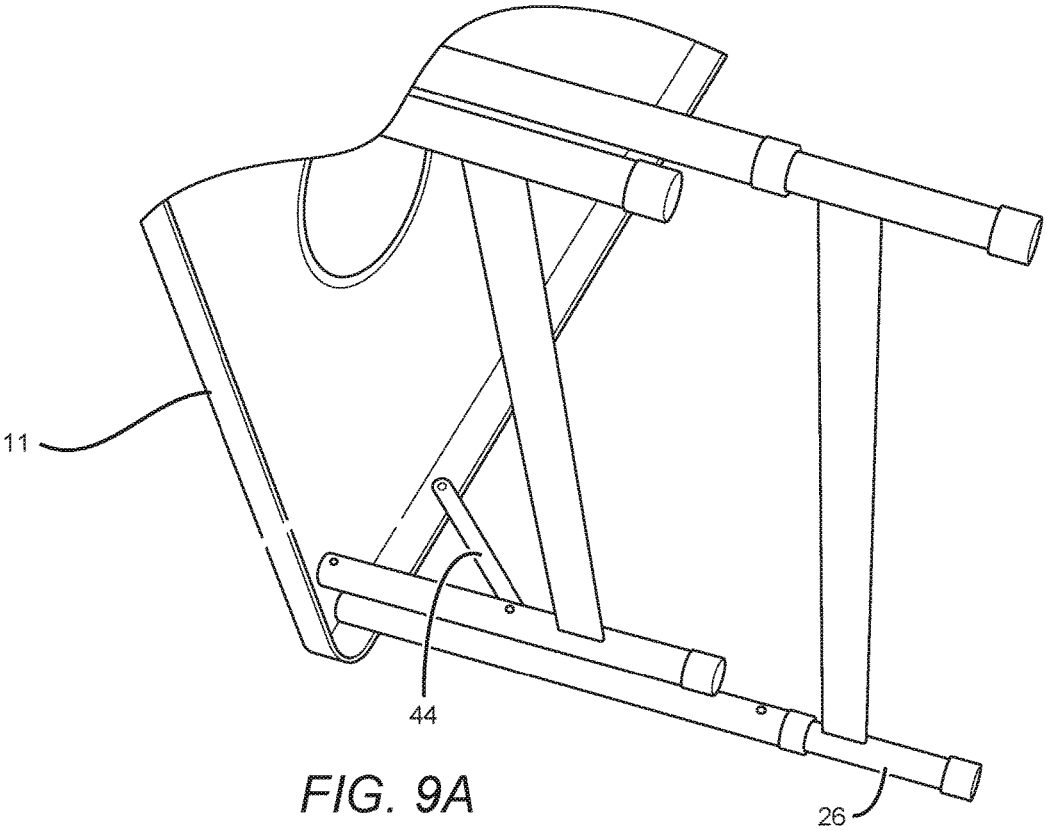
FIG. 9A

FIG. 13
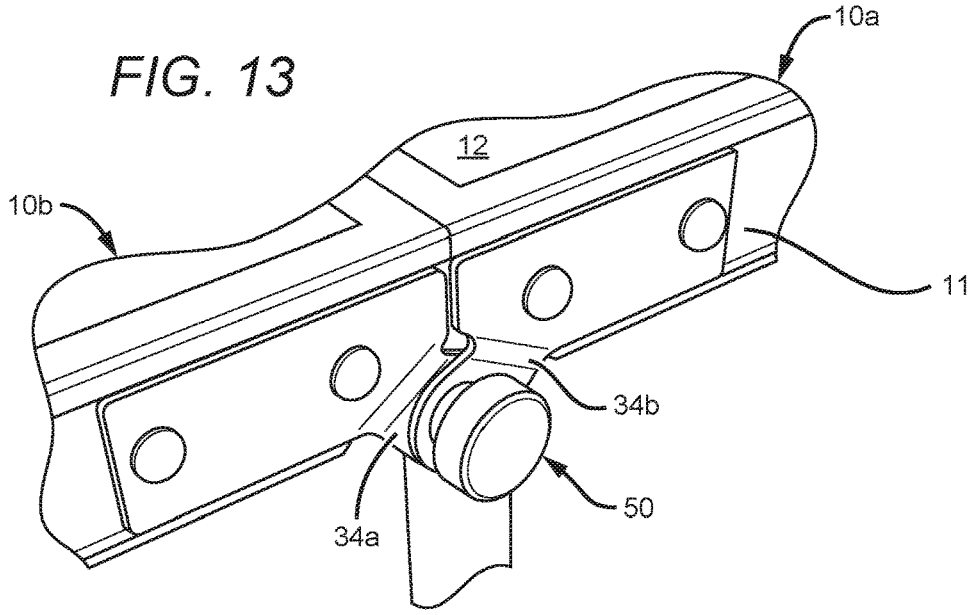
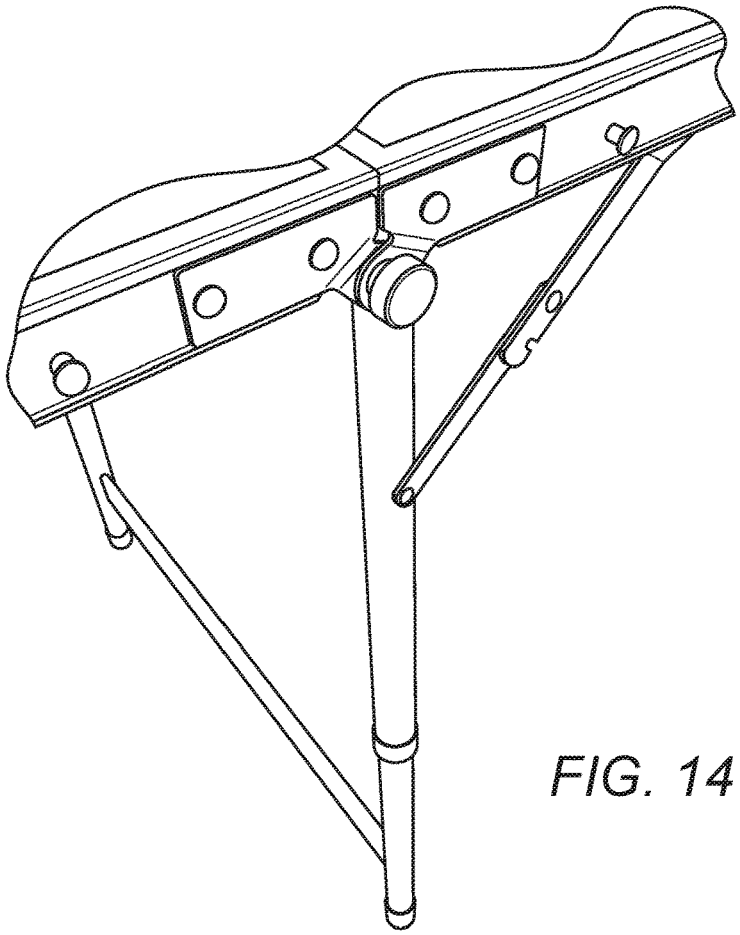
FIG. 14

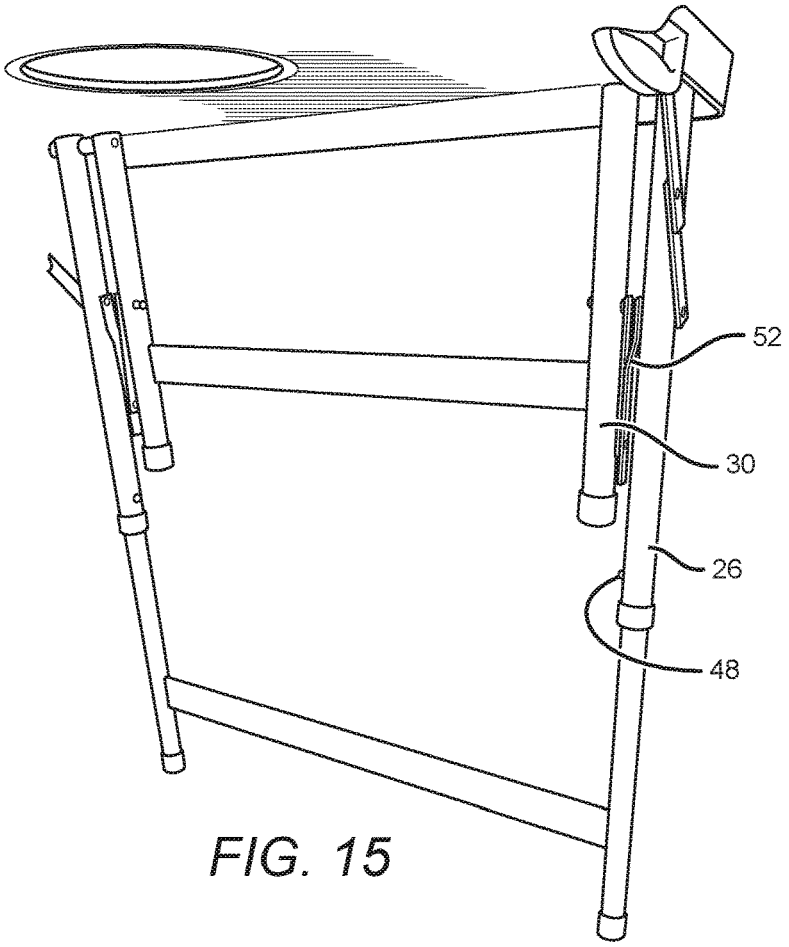
FIG. 15
FIG. 16
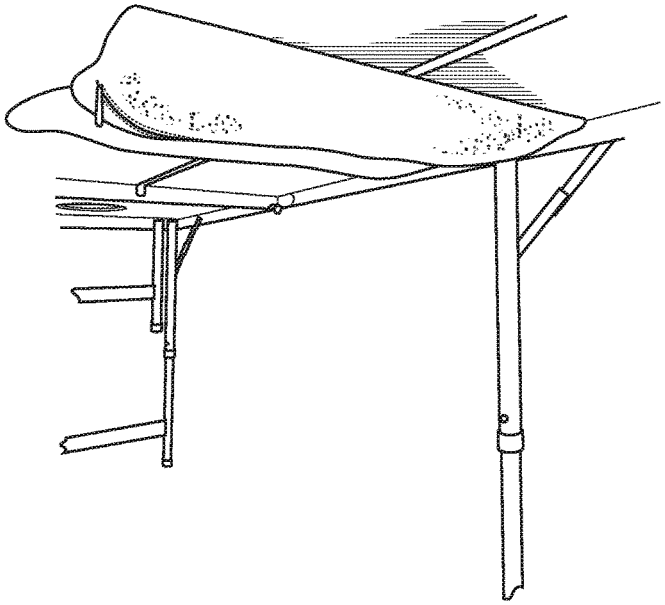

MODULAR MULTI-USE SURFACE SET

RELATED APPLICATION

This application claims the benefit of U.S. Provisional Application No. 62/377,521, filed on 19 Aug. 2016. The application referenced in this paragraph is hereby incorporated by reference as if set forth fully herein.

BACKGROUND OF THE DISCLOSURE

Field of the Invention

The subject matter of the disclosure relates to modular multi-use surface sets and, more specifically, to convertible tables that may be used as surfaces to play popular social games such as "Beer Pong" and "Cornhole."

Background

Over the past few decades, certain social games have become increasingly widespread, especially on college campuses. Among these are two particularly popular games known as "Beer Pong" and "Cornhole."

Beer Pong, also known as Beirut, is a game in which players throw a ping pong ball across a table with the intent of landing the ball in a cup partially filled with liquid (usually beer) on the other end. The game typically consists of opposing teams of two or more players per side with 6 or 10 cups set up in a triangle formation on each side. Each team then takes turns attempting to shoot ping pong balls into the opposing team's cups. If a ball lands in a cup, the cup is removed from the table. In some versions, the contents of the cup are consumed by the opposing team as the cup is removed. The first team to eliminate all of the opponent's cups is the winner. Beer Pong requires the following equipment to play: two ping pong balls; 12-20 plastic cups; and an elongated surface, often a folding table.

Cornhole (also known as Bean Bag Toss, or simply Bags) is a lawn game in which players take turns throwing bags of corn (or bean bags) at a raised platform with a hole in the far end. A bag in the hole scores 3 points, while one remaining on the surface of the platform after the round is over scores 1 point. Cumulative or differential scoring may be used. Play continues until a team or player reaches (or exceeds) the score of 21, with most scoring systems using a win-by-two format. Cornhole requires the following equipment: two sets of bags; two platforms.

Both Beer Pong and Cornhole are often played outdoors, for example, at tailgate parties, at the beach, or in parks. It is therefore often difficult and cumbersome to carry all the equipment necessary to play these games to the desired location, especially given the relatively large size of the surfaces required to play them. This is especially true at gatherings where both games will be played.

Thus, there is a need for a compact, easily portable system that is capable of conversion between distinct gameplay modes, for example, a system that is convertible between a Beer Pong table and a Cornhole set.

BRIEF DESCRIPTION OF THE DRAWINGS

FIG. 2 is a side view of a multi-use surface set shown in carry mode according to the disclosure.

FIG. 3 is a close-up side view of a multi-use surface set shown in carry mode according to the disclosure.

FIG. 4 is a detailed close-up side view of a multi-use surface set shown in carry mode according to the disclosure.

FIG. 5 is a detailed close-up side view of a multi-use surface set shown in carry mode according to the disclosure.

FIG. 8A is a detailed close-up bottom view of a multi-use surface set according to the disclosure.

FIG. 8B is a detailed close-up bottom view of a multi-use surface set according to the disclosure.

FIG. 9A is a detailed close-up bottom view of a multi-use surface set according to the disclosure.

FIG. 13 is a detailed close-up side view of a multi-use surface set shown in table mode according to the disclosure.

FIG. 14 is a side perspective view of a multi-use surface set shown in table mode according to the disclosure.

FIG. 15 is a bottom perspective view of a multi-use surface set shown in table mode according to the disclosure.

FIG. 16 is a bottom perspective view of a multi-use surface set shown in table mode according to the disclosure.

DETAILED DESCRIPTION

The present disclosure includes modular multi-use surface sets that are particularly well-suited for use as tables for popular social games such as Beer Pong and Cornhole.

The disclosure is described herein with reference to certain embodiments, but it is understood that the devices/systems can be embodied in many different forms and should not be construed as limited to the embodiments set forth herein. In particular, embodiments of the disclosure are described below in regards to certain modular multi-use surface sets, such as game tables for example.

It is understood that when an element can be referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

In the most general sense, one embodiment of the present disclosure comprises a multi-use surface set that may be used as a convertible game set. The set has sub-sections that are configurable as a Beer Pong table when connected and configurable as a pair of Cornhole platforms when disconnected. In other words, the multi-use surface set is operable in several modes of use, such as a regular table mode (or Beer Pong mode), platform mode (or Cornhole mode), and carry mode.

Figure 1A:
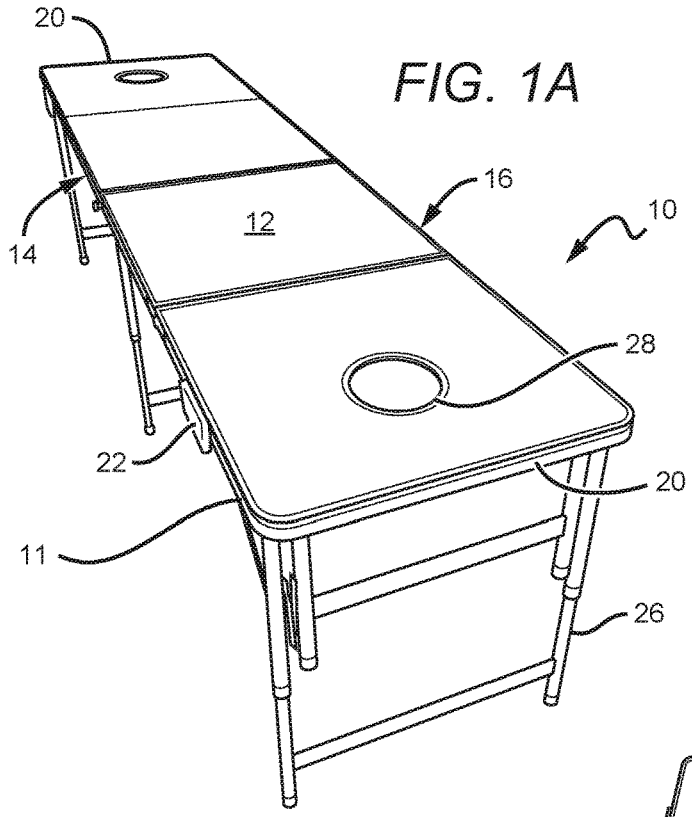
FIG. 1A is a top perspective view of a multi-use surface set shown in table mode according to the disclosure.

FIG. 1A is a top perspective view of a multi-use surface set 10 shown in table mode (or Beer Pong mode) according to the disclosure. In the table, the multi-use surface set 10 comprises a rigid frame 11 generally defining the shape of the set, a top surface 12 on or connected to the frame 11. In table mode, the frame 11 has a first side 14, a second side 16, two end sides 20, and at least one collapsible table leg 26, usually a pair of table legs 26 on each end. The multi-use surface set can also comprise one or more handles 22 on said frame, such as two handles for example, and/or two holes 28. If left open, the holes 28 may be used for holding devices. In other modes, e.g., platform mode, the holes are used as part of the game. The multi-use surface set generally comprises multiple sub-sections of the multi-use surface set 10 such as a first sub-sub-section 10*a* and a second sub-sub-section 10*b*, as shown in FIG. 1B.

Figure 1B:
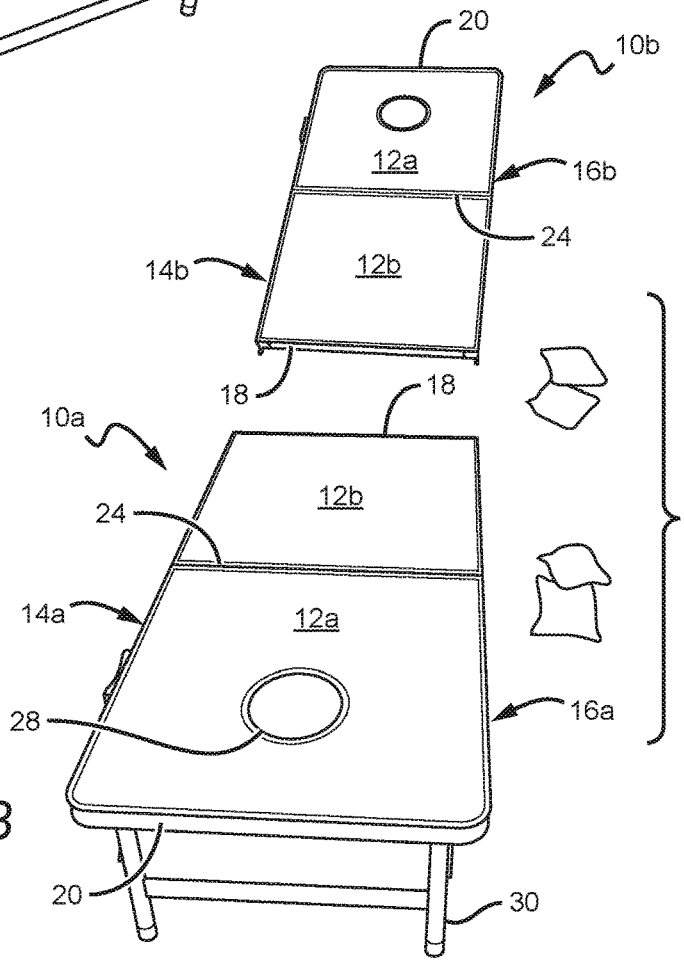
FIG. 1B is a top perspective view of a multi-use surface set shown in Platform mode according to the disclosure.

FIG. 1B is a top perspective view of the multi-use surface set 10 shown in platform mode (or Cornhole mode) according to the disclosure. The first sub-section 10*a* generally comprises a first section top surface 12*a*, a second section top surface 12*b*, section one of the first side 14*a*, section one of the second side 16*a*, a third side 18, an end side 20, a hole 28, and platform legs 30. The first section top surface 12*a* can meet flush with the second section top surface 12*b* at hinge joint 24 to create a continuous flat surface. The first sub-section 10*a* can also comprise a handle 22 for easy transportation, especially in the carry mode. Similarly, the second sub-section 10*b* generally comprises a first section top surface 12*a*, a second section top surface 12*b*, section two of the first side 14*b*, section two of the second side 16*b*, a third side 18, an end side 20, a hole 28, and platform legs 30. The first section top surface 12*a* can meet flush with the second section top surface 12*b* at hinge joint 24 to create a continuous flat surface. The second sub-section 10*b* can also comprise a handle 22 for easy transportation, especially in the carry mode.

FIG. 2 is a side view of the multi-use surface set 10 shown in carry mode according to the disclosure. FIG. illustrates a user carrying the first sub-section of 10*a* and the second sub-section 10*b* by the handles 22, which in this embodiment, are on the first side 14, but could easily be placed on any side in other embodiments. Thus, in carry mode, the sub-sections 10*a*, 10*b* can be carried by the handles 22 as if they were a single unit. Hinges 36 are on either side of the hinge joint 24 such that the first sub-section 10*a* can fold onto the second sub-section 10*b*. The sub-sections 10*a*, 10*b* are divided by the hinge joints 24 into an exterior half and an interior half, wherein the exterior and interior halves each can fold into a closed position and unfold into an open position about the hinge joint 24, such that the surface set 10 is configured in the carry mode when said halves are in the closed position. In the closed position, the back of the first sub-section 10*a* faces the back of the second sub-section 10*b*, and the top surface 12 faces outward.

Pairs of connectors 34*a*, 34*b*, in this embodiment joint brackets, are positioned by the third side 18 of the first sub-section 10*a* and the second sub-section 10*b* with a total of four connectors 34. A first connector 34*a* on the first sub-section 10*a* and a second connector 34*b* on the second sub-section 10*b* correspond to releasably join the sub-sections 10*a*, 10*b* to provide a continuous table top surface across both.

FIG. 3 is a close-up side view of the multi-use surface set 10 shown in carry mode according to the disclosure. Latches 32 shown in FIG. 3 on the first side 14, can be on or near a side of the first sides 14 of the first sub-section 10*a* and a side of the second sub-section 10*b*. Latches 32, when engaged, secure the first sub-section top surface 12*a* to the second sub-section top surface 12*b* for transportation or storage.

FIG. 4 is a detailed close-up side view of the multi-use surface set 10 shown in carry mode according to the disclosure. On the first side 14 is a pair of connectors 34*a*, 34*b*. The connector 34*a* comprises an extended portion with a hole that is at least partially medially positioned, and the connector 34*b* comprises an extended portion with a hole that is at least partially laterally positioned. Therefore, when one of the sub-sections 10*a*, 10*b* of is unfolded, the connectors do not collide.

FIG. 5 is a detailed close-up side view of the multi-use surface set 10 shown in carry mode according to the disclosure. The hinges 36 allow the first section top surfaces 12*a* of the first sub-section 10*a* and the second sub-section 10*b* to fold onto the second section top surfaces 12*b* of the first sub-section 10*a* and the second sub-section 10*b*, respectively.

Figure 6:
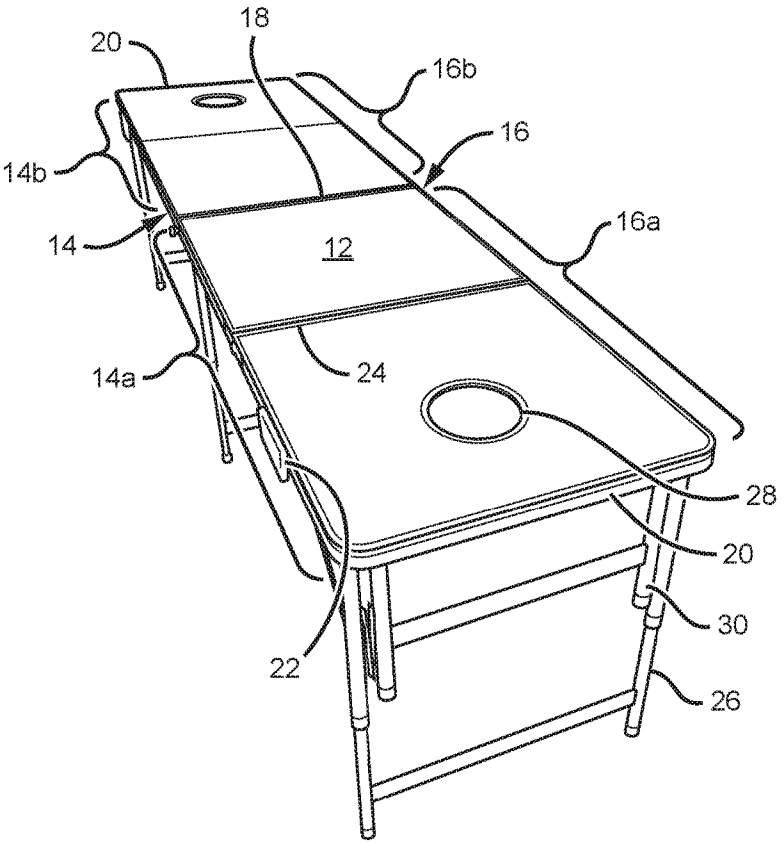
FIG. 6 is a top perspective view of a multi-use surface set shown in table mode according to the disclosure.

FIG. 6 is a top perspective view of the multi-use surface set 10 shown in table mode according to the disclosure. The top surface 12 may comprise a smooth waterproof material, such as melamine laminate, but may also comprise many alternate materials and can be smooth, textured, and/or gripped. Designs also can be placed on the top surface 12, such as aesthetic designs or markings for use during one of the modes, for example a triangle to mark placement on the table for cups during Beer Pong. The layer under the top surface 12 can be any kind of rigid material to support the top surface 12, for example medium-density fiberboard. The top layer 12 may also be rigid enough to not require a support layer underneath. The multi-use surface set 10 comprises multiple table legs 26, such as two, three, four, five, six, seven, or eight. FIG. 6 shows that the platform legs 30 are not in use while the multi-use surface set 10 is in table or Beer Pong mode. When in table or Beer Pong mode, section one of the first side 14*a* and section two of the first side 14*b* are joined and flush with each other. Similarly, section one of the second side 16*a* and section two of the second side 16*b* are joined and flush with each other. Thus, the third ends 18 are also flush with each other. Dimensions of the multi-use surface set 10 may be varied according to its intended uses. FIG. 6 shows a top surface 12 with dimensions roughly two feet by eight feet and a height of approximately 28.5 inches.

Figure 7:
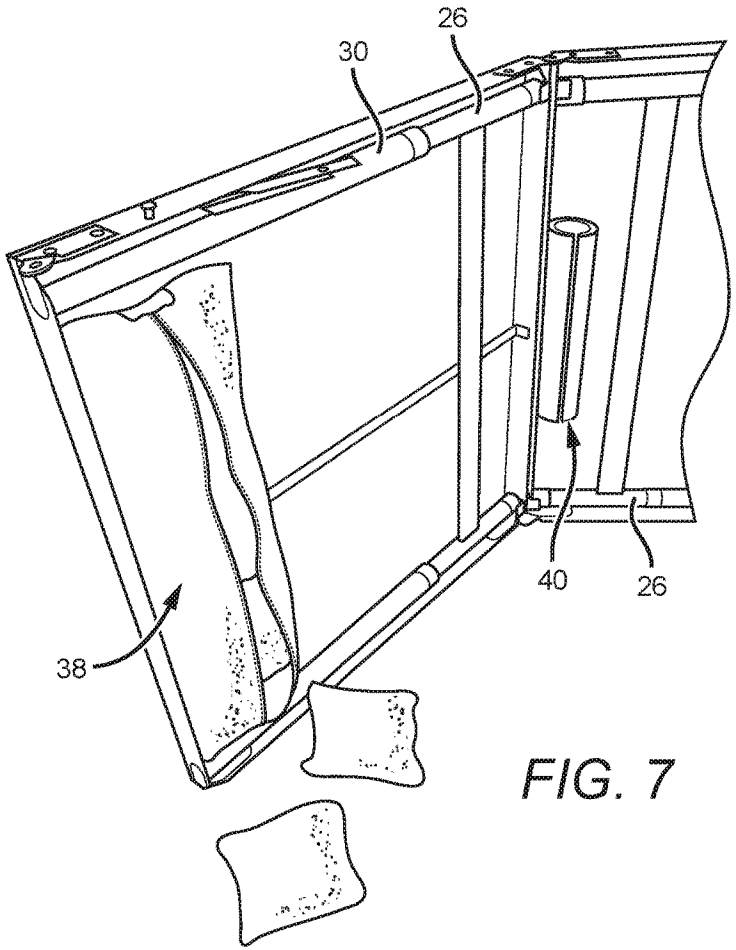
FIG. 7 is a bottom perspective view of a multi-use surface set according to the disclosure.

FIG. 7 is a bottom perspective view of the multi-use surface set 10 according to the disclosure. FIG. 7 illustrates the first step to converting the multi-use surface set 10 from carry mode to table or Beer Pong mode. The first sub-section 10*a* and the second sub-section 10*b* are unfolded after unfastening the latches 32, such that the corresponding first section top surface 12*a* is no longer on the second section top surface 12*b* as shown in FIG. 2. As shown in FIG. 7, the table legs 26 and the platform legs 30 are folded under the top surface 12. A storage pouch 38 may be attached to the underside of the top surface 12 for various uses, such as storing the bags for Cornhole, for example. A storage tube 40 may also be attached to the underside of the top surface 12 or to the frame 11 for additional storage of items such as instructions and/or a bag of instruments such as screws and connectors, for example.

FIG. 8A is a detailed close-up bottom view of the multi-use surface set 10. The table legs 26 and the platform legs 30 are folded underneath and parallel against the underside of the top surface 12. The table legs 26 are longer than the platform legs 30. For instance, the platform legs 30 may be about twelve inches or another suitable length. The table legs 26 are secured within the brace 42 to ensure that the table legs and the platform legs 30 do not unfold unintentionally. The brace 42 is on the frame 11 opposite said top surface 12 and is configured to receive the table leg 26 when collapsed underneath the top surface and in an intermediate position (as discussed in more detail with reference to FIGS. 9A and 9B).

FIG. 8B is a detailed close-up bottom view of the multi-use surface set 10 according to the disclosure. The table legs 26 are adjustable in length and can be adjusted to an extended position (maximum length), a retracted position (minimum length), and any number of intermediate lengths therebetween. In some embodiments, the table legs 26 comprise a leg base 25 and a leg extension 27. The leg extension 27 fits at least partially within the leg base 25 and can extend from the leg base 25 or retract into the leg base 25, using a telescoping action. To unfold the table legs 26 and the platform legs 30, a force is applied to the leg extensions 27 parallel to the legs and away from the brace 42. A sufficient force causes the leg extensions 27 to retract into the leg bases 25, shortening the table legs 26 to an intermediate position and causing them to disengage from the braces 42. FIG. 8B shows the table legs 26 after they have been released from the brace 42.

FIG. 9A is a detailed close-up bottom view of the multi-use surface set 10 according to the disclosure. The table legs 26 and the platform legs 30 are pivotably attached to the corners of the sub-sections 10*a*, 10*b* and can be unfolded by swinging the ends of the legs away from the top surface 12, down from the frame 11. The table frame 11 runs along at least part of the perimeter of the top surface 12 and extends below the top surface 12 a short distance. A securing arm 44 is connected on one end to the frame 11 and on the other end to a table leg 26 and can lock into place to secure the extended position of the table legs 26 and the platform legs 30.

Figure 9B:
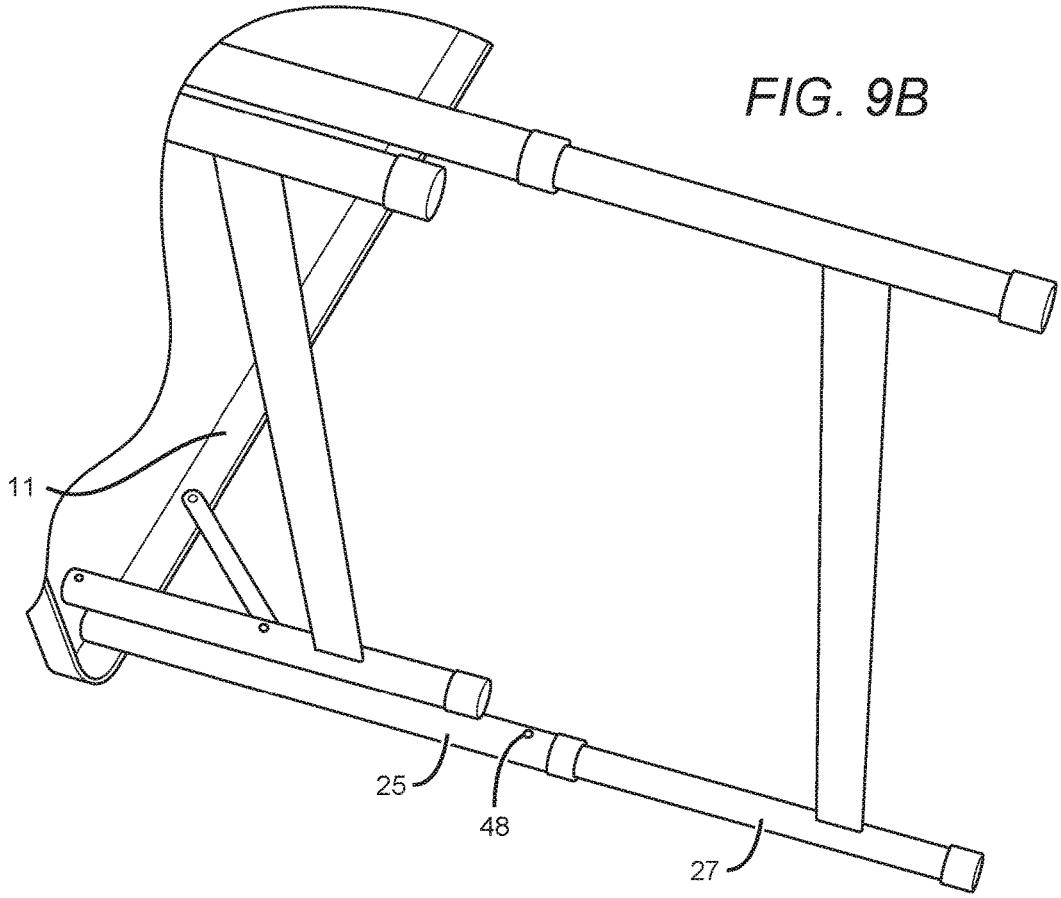
FIG. 9B is a detailed close-up bottom view of a multi-use surface set according to the disclosure.

FIG. 9B is a detailed close-up bottom view of a portion of the multi-use surface set 10 according to the disclosure. In this particular embodiment, the leg bases 25 each have at least one hole and the leg extensions 27 each have a pin 48 that can fit into the at least one hole. The table legs 26 are lengthened by extending the leg extensions 27 from the bases 25, and the table legs 26 are locked to a desired length by engaging the pin 48 into the appropriate hole.

Figure 10:
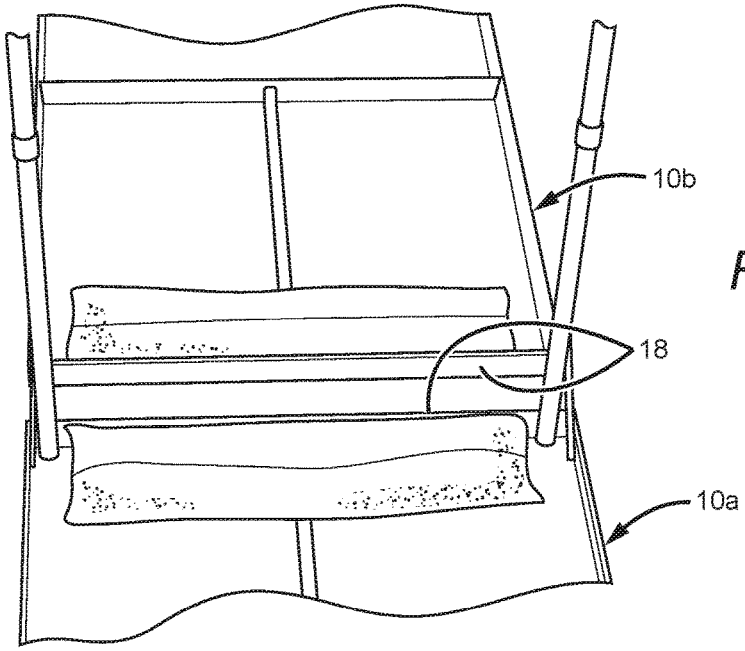
FIG. 10 is a bottom perspective view of a multi-use surface set according to the disclosure.

FIG. 10 is a bottom perspective view of a portion of the multi-use surface set 10 according to the disclosure. The third side 18 of the first sub-section 10*a* is positioned flush against the third side 18 of the second sub-section 10*b*.

Figure 11:
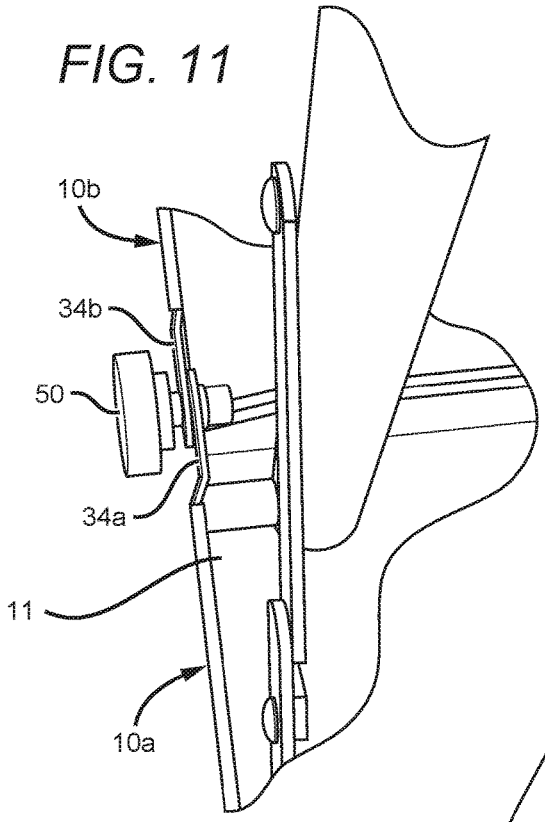
FIG. 11 is a detailed close-up bottom view of a multi-use surface set shown in table mode according to the disclosure.

FIG. 11 is a detailed close-up bottom view of a portion of the multi-use surface set 10 shown in table mode according to the disclosure. When first and second sections 10*a*, 10*b* are unfolded, the connectors 34*a*, 34*b* are then slotted together such that their holes are aligned. The knob screw is then fitted through the aligned holes of the connectors 34*a*, 34*b* and screwed into place. A similar pair of connectors are on the opposite side of the sub-sections 10*a*, 10*b* such that the they are locked into place in the table mode configuration. Once the knob screw 50 is securely within the connectors 34*a*, 34*b*, the first side 14, the second side 16, and the top surface 12 of the first sub-section 10*a* are flush with the first side 14, the second side 16, and the top surface 12 of the second sub-section 10*b*, respectively.

Figure 12:
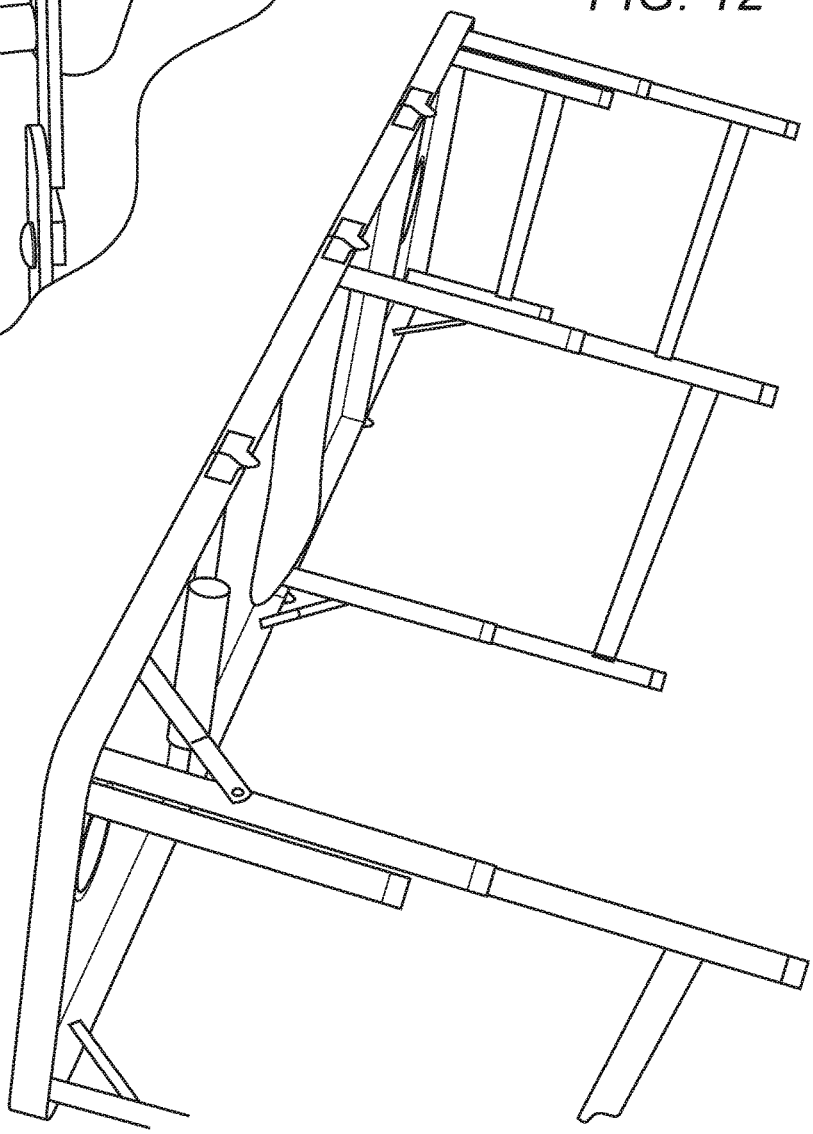
FIG. 12 is a side view of a multi-use surface set shown in table mode according to the disclosure.

FIG. 12 is a bottom side perspective view of the multi-use surface set 10 shown in table mode according to the disclosure.

FIG. 13 is a detailed close-up side view of a portion of the multi-use surface set 10 shown in table mode according to the disclosure. As the knob screw 50 is securely fastened within the connectors 34*a*, 34*b* and the adjoining sides are flush with each other, the first sub-section 10*a* and the second sub-section 10*b* are securely connected, providing a flat top surface 12.

FIG. 14 is a top side perspective view of a portion of the multi-use surface set 10 shown in table mode according to the disclosure.

FIG. 15 is a bottom perspective view of one end of the multi-use surface set 10 shown in table mode. The platform legs 30 fit between the table legs 26 as the distance between pairing platform legs 30 is less than the distance between pairing table legs 30. Another embodiment comprises table legs 26 that are between platform legs 30. The pins 48 are engaged in the corresponding hole in the table legs 26. A platform leg securing arm 52 is shown folded and connecting a table leg 26 to a platform leg 30.

FIG. 16 is a bottom perspective view of a portion of the multi-use surface set 10 shown in table mode according to the disclosure.

Figure 17:
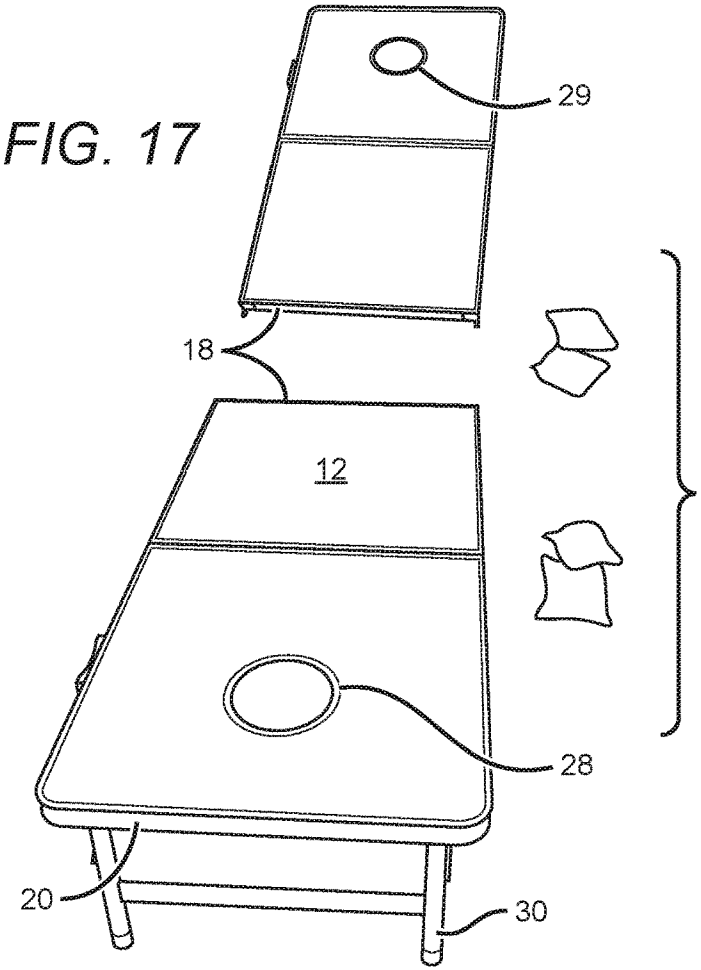
FIG. 17 is a top perspective view of a multi-use surface set shown in platform mode according to the disclosure.

FIG. 17 is a top perspective view of the multi-use surface set 10 shown in platform mode according to the disclosure. The first sub-section 10*a* and the second sub-section 10*b* are separated in this mode. The platform legs 30 are extended while the table legs 26 are folded underneath and parallel with the top surface 12 such that the third side 18 is resting against the ground. In this embodiment, the hole 28 is approximately six inches in diameter and roughly nine inches from the end side 20 such that the devices may be used for the Cornhole game. However, the hole 28 may be of any size and at any location on the top surface 12 to accommodate numerous uses and games. The hole 28 can also be fitted with a ring 29 along the inside of the hole. The ring 29 protects the hole 28 and can be made of numerous materials such as plastic. The ring 29 can extend partially over and under the top surface 12 along the perimeter of the hole 28 and can be removable and of various thicknesses, such as approximately 1/16 of an inch. In some embodiments, a detachable triangular insert is placed around the ring 29 such that the triangular insert is flush with the ring 29. The triangular insert may be made of numerous types of materials such as plastic or foam and can have markers or aesthetic designs on the face of it. The triangular insert can also be of a specific size and shape for marking the appropriate placement of cups for Beer Pong. In table mode, it may be desirable to use an insert sized to fit snugly within the hole 28 to provide a continuous flat surface around and over the hole 28. In other embodiments, the insert can consist of alternate shapes and sizes.

Figure 18:
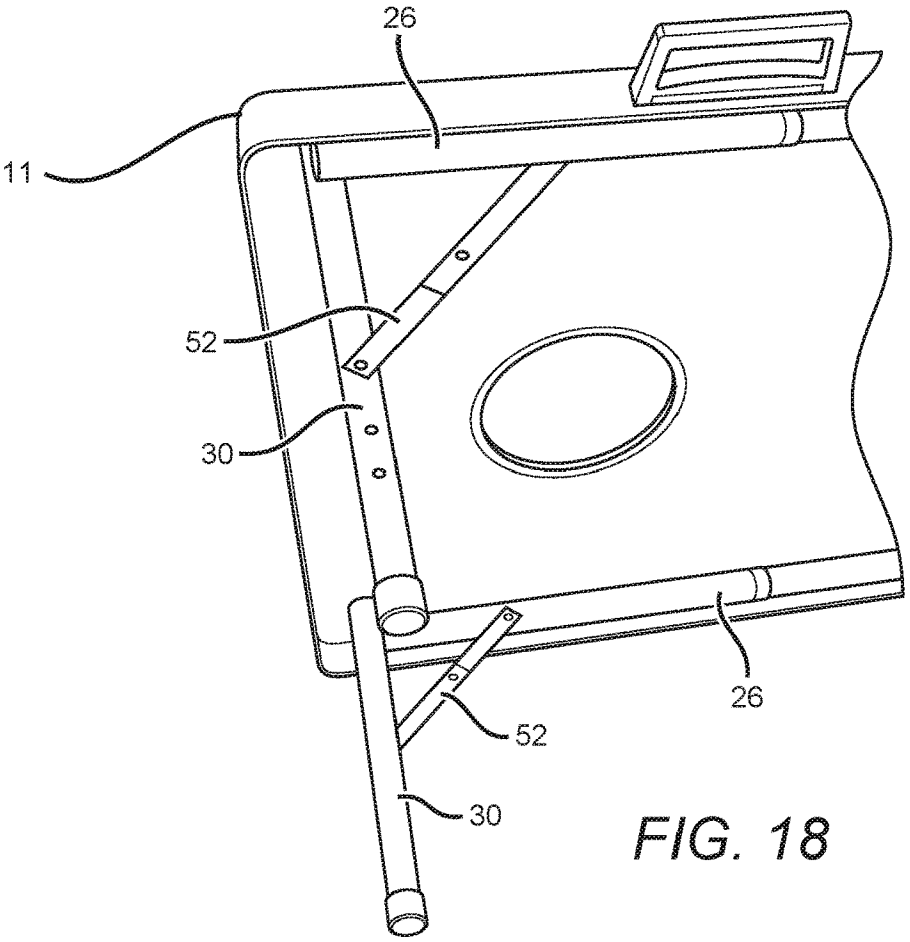
FIG. 18 is a bottom perspective view of a multi-use surface set shown in platform mode according to the disclosure.

FIG. 18 is a bottom perspective view of a portion of the multi-use surface set 10 shown in platform mode according to the disclosure. A securing arm 52 is connected to each platform leg 30 at one end and each table leg 26 at the opposite end. As shown in FIG. 15, the platform leg securing arm 52 is folded when not in use and extends when the platform leg 30 is extended and the table leg 26 remains folded under the top surface 12. The platform leg securing arm 52, when extended, locks the platform leg 30 in its extended position.

Figure 19:
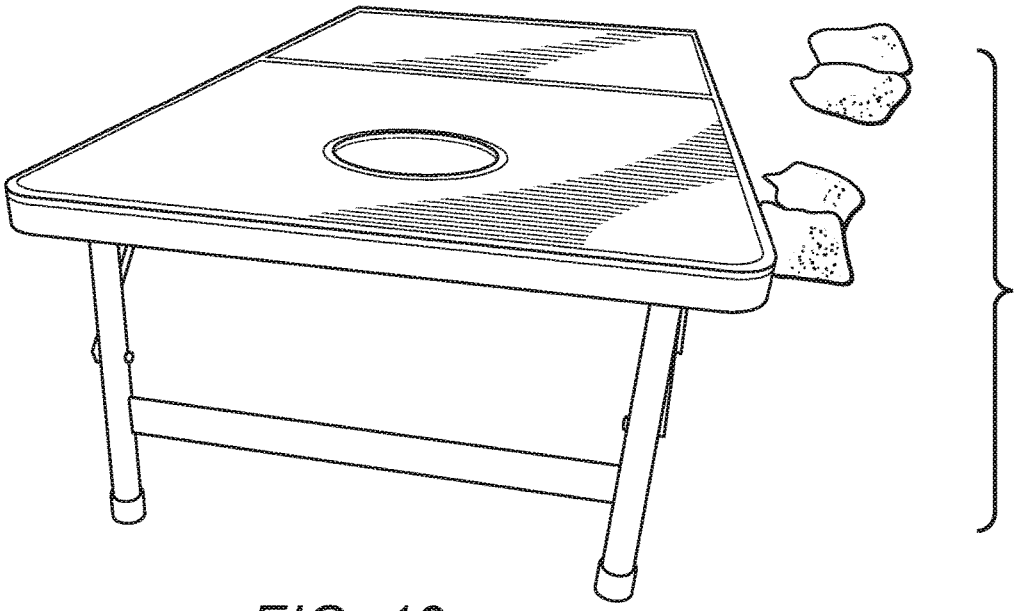
FIG. 19 is a side perspective view of a multi-use surface set shown in platform mode according to the disclosure.

FIG. 19 is a side perspective view of a portion of the multi-use surface set 10 shown in platform mode according to the disclosure.

Figure 20:
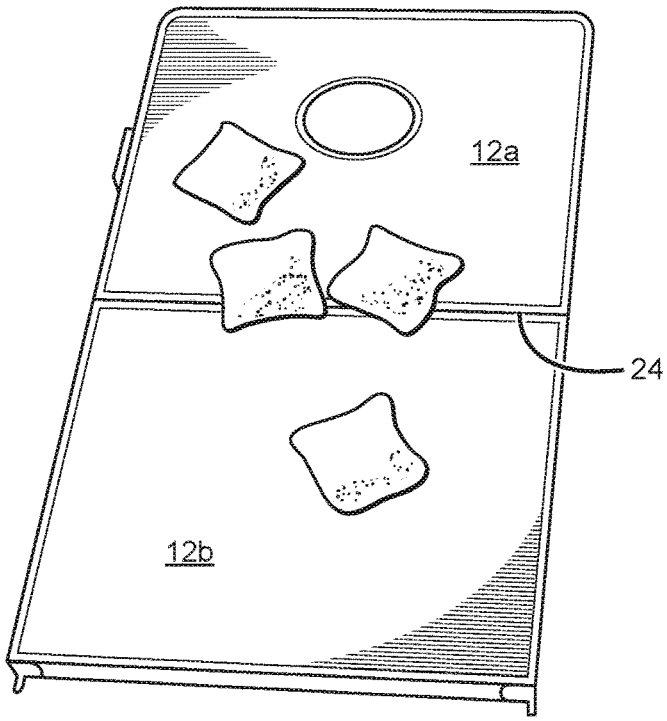
FIG. 20 is a top perspective view of a multi-use surface set shown in platform mode according to the disclosure.

FIG. 20 is a top perspective view of a portion of the multi-use surface set 10 shown in platform mode. The hinge joint 24, the first section top surface 12*a* and the second section top surface 12*b* are all flush with each other to act as a single flat top surface.

Figure 21:
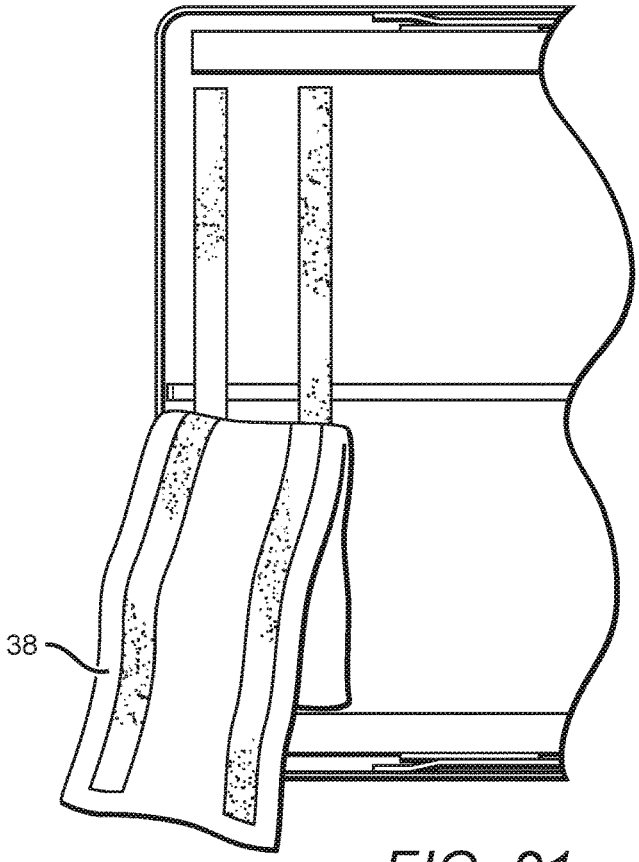
FIG. 21 is a bottom perspective view of a multi-use surface set according to the disclosure.

FIG. 21 is a bottom perspective view of a portion of the multi-use surface set 10 according to the disclosure. The storage pouch 38 may be removably attached to the underside of the top surface 12 or to the frame 11 by many different types of attachment mechanism, such as hook and loop attachment mechanisms, for example. A portion of the pouch 38 is shown removed in this view to reveal the hook and loop attachment mechanism in this particular embodiment.

Figure 22:
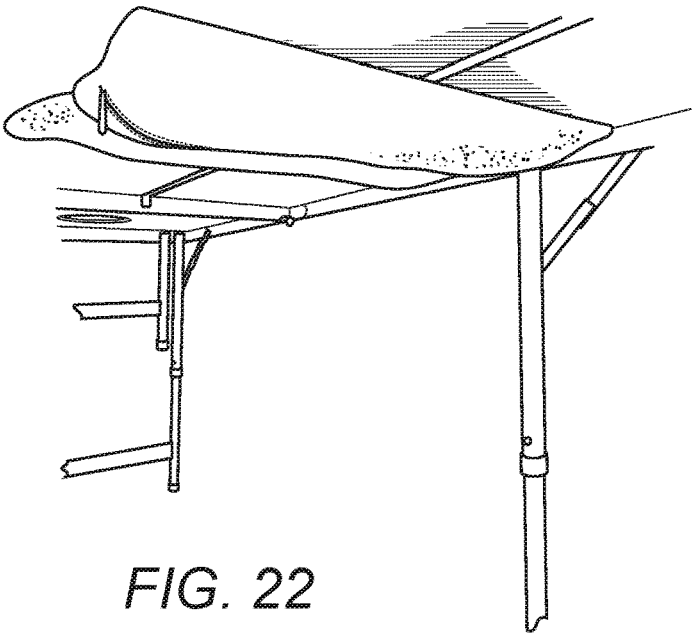
FIG. 22 is a bottom perspective view of a multi-use surface set shown in table mode according to the disclosure.

FIG. 22 is a bottom perspective view of a portion of the multi-use surface set 10 shown in table mode.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

I claim:

1. A modular multi-use surface set, comprising:

first and second sub-sections, each of said sub-sections comprising:

a rigid frame comprising first and second exterior side segments;

a top surface on said frame;

at least one collapsible table leg; and at least one collapsible platform leg;

a first connector defining a first hole on said first exterior side segment of said first sub-section;

a second connector defining a second hole on said second exterior side segment of said second sub-section, said second connector configured to correspond with said first connector such that said first and second holes are aligned; and a knob screw sized to fit through said first and second holes to releasably join said first and second sub-sections to provide a continuous table top surface across both sub-sections;

wherein said surface set is configurable into a table mode when said first and second sub-sections are joined and configurable into a platform mode when said first and second sub-sections are separated.

2. The modular multi-use surface of claim 1, each of said sub-sections comprising a hinge joint dividing said sub-sections into an exterior half and an interior half, wherein said exterior and interior halves each can fold into a closed position and unfold into an open position about said hinge joint, such that said surface set is configurable into a carry mode when said halves are in said closed position.

3. The modular multi-use surface of claim 2, each of said sub-sections further comprising a latch, said latch configured to releasably secure said interior and exterior halves in said closed position.

4. The modular multi-use surface set of claim 2, each of said sub-sections further comprising a handle on said frame, said handles accessible when said surface set is configured in said carry mode such that said sub-sections can be carried as a single unit.

5. The modular multi-use surface set of claim 1, said at least one collapsible table leg adjustable between a retracted position, an extended position, and at least one intermediate position therebetween.

6. The modular multi-use surface set of claim 5, further comprising at least one brace on said frame opposite said top surface, said at least one brace configured to receive said at least one table leg when said table leg is collapsed underneath said top surface and in one of said intermediate positions.

7. The modular multi-use surface set of claim 1, wherein each of said sub-section top surfaces is shaped to define a hole.

8. The modular multi-use surface set of claim 7, further comprising an insert sized to fit within said hole to provide a continuous flat surface around and over said hole.

9. The modular multi-use surface set of claim 1, further comprising a storage pouch releasably attached to one of said sub-sections.

10. The modular multi-use surface set of claim 1, further comprising a storage tube releasably attached to one of said sub-sections.

11. The modular multi-use surface set of claim 1, wherein said surface set can be used to play the social game Beer Pong when configured in said table mode.

12. The modular multi-use surface set of claim 1, wherein said surface set can be used to play the social game Cornhole when configured in said platform mode.

13. A convertible table/platform set, comprising:

first and second sub-sections, each of said sub-sections comprising:

a frame generally defining the shape of said sub-section;

a top surface connected to said frame;

a pair of collapsible table legs, said table legs adjustable between a stowed position parallel with and underneath said top surface and a support position perpendicular to said top surface; and a pair of collapsible platform legs, said platform legs adjustable between a stowed position parallel with and underneath said top surface and a support position perpendicular to said top surface;

a first connector on said first sub-section;

a second connector on said second sub-section, said second connector configured to correspond with said first connector to releasably join said first and second sub-sections to provide a continuous table top surface across both sub-sections; and first and second swivel handles, said first swivel handle on an exterior side segment of said first sub-section frame, said second swivel handle on an exterior side segment of said second sub-section frame, such that when said first and second sub-sections are folded into a closed position said first and second handles can be gripped simultaneously, allowing said first and second sub-sections to be carried as a single unit;

wherein said table/platform set is configurable into a table mode when said first and second sub-sections are joined and configurable into a platform mode when said first and second sub-sections are separated.

14. The convertible table/platform set of claim 13, each of said sub-sections comprising a hinge joint dividing said sub-sections into an exterior half and an interior half, wherein said exterior and interior halves each can fold into said closed position and unfold into an open position about said hinge joint, such that said table/platform set is configurable into a carry mode when said halves are in said closed position.

15. The convertible table/platform set of claim 14, each of said sub-sections further comprising a handle on said frame, said handles accessible when said table/platform set is configured in said carry mode such that said sub-sections can be carried as a single unit.

16. The convertible table/platform set of claim 13, said table legs adjustable between a retracted position, an extended position, and at least one intermediate position therebetween.

17. The convertible table/platform set of claim 16, further comprising at least one brace on said frame opposite said top surface, said at least one brace configured to receive one of said table legs when said table legs are in said stowed position.

18. The convertible table/platform set of claim 13, wherein each of said sub-section top surfaces is shaped to define a hole.

19. The convertible table/platform set of claim 18, further comprising an insert sized to fit within said hole to provide a continuous flat surface around and over said hole.

* * * * *